US011112221B2

(12) United States Patent
Church et al.

(10) Patent No.: US 11,112,221 B2
(45) Date of Patent: Sep. 7, 2021

(54) OIL WELL PERFORATORS

(71) Applicant: QinetiQ Limited, Hampshire (GB)

(72) Inventors: Philip Duncan Church, Bexley Heath (GB); Robert Peter Claridge, Sevenoaks (GB); Peter John Gould, Bristol (GB); Richard Gordon Townsley, Tonbridge (GB)

(73) Assignee: QinetiQ Limited, Hampshire (GB)

( * ) Notice: Subject to any disclaimer, the term of this patent is extended or adjusted under 35 U.S.C. 154(b) by 0 days.

(21) Appl. No.: 16/855,713

(22) Filed: Apr. 22, 2020

(65) Prior Publication Data

US 2020/0300586 A1 Sep. 24, 2020

Related U.S. Application Data

(63) Continuation of application No. 13/811,331, filed as application No. PCT/GB2011/001119 on Jul. 26, 2011, now Pat. No. 10,704,867.

(30) Foreign Application Priority Data

Jul. 29, 2010 (GB) ..... 1012716

(51) Int. Cl.
*F42B 1/032* (2006.01)
*E21B 43/117* (2006.01)

(52) U.S. Cl.
CPC ..... *F42B 1/032* (2013.01); *E21B 43/117* (2013.01)

(58) Field of Classification Search
CPC ..... F41H 11/02; F41H 11/00; F41H 13/00; F41F 3/04; F41F 5/00
See application file for complete search history.

(56) References Cited

U.S. PATENT DOCUMENTS 3,235,005 A 2/1966 Delacour
3,675,575 A 7/1972 Bailey et al.
(Continued)

FOREIGN PATENT DOCUMENTS

CA 2590052 6/2006
DE 102005059934 8/2006
(Continued)

OTHER PUBLICATIONS

Aluminium-online catalogue source—supplier of research materials in small quantities, http://www.goodfellow.com/E/Aluminium, html., May 19, 2016, 4 pages.
(Continued)

*Primary Examiner* — J. Woodrow Eldred
(74) *Attorney, Agent, or Firm* — McDonnell Boehnen Hulbert & Berghoff LLP

(57) ABSTRACT

An oil and gas well shaped charge perforator capable of providing an exothermic reaction after detonation is provided, comprising a housing (2), a high explosive (3), and a reactive liner (6) where the high explosive is positioned between the reactive liner and the housing. The reactive liner (6) is produced from a reactive composition which is capable of sustaining an exothermic reaction during the formation of the cutting jet. The composition is a pressed i.e. compacted particulate composition comprising at least two metals, wherein one of the metals is present as spherical particulate, and the other metal is present as a non-spherical particulate. There may also be at least one further metal, which is not capable of an exothermic reaction with the reactive composition, present in an amount greater than 10% w/w of the liner. To aid consolidation a binder may also be added.

17 Claims, 4 Drawing Sheets

(56) References Cited

U.S. PATENT DOCUMENTS

| | | | |
|---|---|---|---|
| 3,255,659 | A | 6/1996 | Venghiattis |
| 5,567,906 | A | 10/1996 | Reese et al. |
| 6,446,558 | B1 | 9/2002 | Peker et al. |
| 8,075,715 | B2 | 12/2011 | Ashcroft et al. |
| 8,220,394 | B2 | 7/2012 | Bates et al. |
| 8,322,284 | B2 | 12/2012 | Meddes et al. |
| 8,544,563 | B2 | 10/2013 | Bourne et al. |
| 10,704,867 | B2 * | 7/2020 | Church ..... E21B 43/117 |
| 2002/0185030 | A1 | 12/2002 | Reese et al. |
| 2003/0037692 | A1 | 2/2003 | Liu et al. |
| 2005/0011395 | A1 | 1/2005 | Langan et al. |
| 2005/0115448 | A1 | 6/2005 | Pratt et al. |
| 2007/0056462 | A1 | 3/2007 | Bates et al. |
| 2009/0078144 | A1 | 3/2009 | Behrmann et al. |
| 2010/0096136 | A1 | 4/2010 | Bourne et al. |

FOREIGN PATENT DOCUMENTS

| | | |
|---|---|---|
| EP | 0538135 | 5/1997 |
| EP | 1682846 | 1/2014 |
| WO | 2005/035939 | 4/2005 |
| WO | 2008/069820 | 6/2008 |
| WO | 2008/097241 | 8/2008 |
| WO | 2008/102110 | 8/2008 |

OTHER PUBLICATIONS

Dunbar et al., "High-pressure shock activation and mixing of nickel-aluminum powder mixtures," Journal of Materials Science, 1993, pp. 2903-2914, vol. 28.

Eakins et al., "Mesoscale Simulation of the Configuration-Dependent Shock-Compression Response of Ni+Al Powde Mixtures," Acta Materialia, 2008, pp. 1496-1510, vol. 56.

Eakins et al., "Shock Compression of Reactive Powder Mixtures," International Materials Review, 2009, pp. 181-213, vol. 54, No. 4.

Eakins et al., "The Shock-Densification Behavior of Three Distinct Ni+Al Powder Mixtures," Applied Physics Letters, 2008, 4 pages, vol. 92.

Fischer et al., "A Survey of Combustible Metals, Thermites, and Intermetallics for Pyrotechnic Applications," 32nd AIAA/ASME/SAE/ASEE Joint Propulsion Conference, Jul. 1-3, 1996, 15 pages.

Guo Hong-Jun, et al. "Experimental Study on the Powder Liner", Well Logging Technology, Feb. 2005, 12 pp., vol. 29, No. SO.

Nickel-online catalogue source—supplier of research materials in small quantities, http://www.goodfellow.com/E/Nickel,html., May 19, 2016, 4 pages.

* cited by examiner

OIL WELL PERFORATORS

CROSS REFERENCE TO RELATED APPLICATIONS

This application claims priority to U.S. patent application Ser. No. 13/811,331 filed Jan. 21, 2013, International Application No. PCT/GB2011/001119 filed Jul. 26, 2011, and Great Britain Patent Application No. 1012716.5 filed Jul. 29, 2010, the contents of each of which are incorporated herein by reference in their entirety.

FIELD OF THE INVENTION

The present invention relates to a reactive shaped charge liner for a perforator for use in perforating and fracturing subterranean well completions. The invention also relates to perforators and perforation guns comprising said liners, and methods of using such apparatus.

BACKGROUND OF THE INVENTION

By far the most significant process in carrying out a well completion in a cased well is that of providing a flow path between the production zone, also known as a formation, and the well bore. Typically, the provision of such a flow path is carried out by using a perforator, initially creating an aperture in the casing and then penetrating into the formation via a cementing layer. This process is commonly referred to as a perforation. Typically, the perforator will take the form of a shaped charge. In the following, any reference to a perforator, unless otherwise qualified, should be taken to mean a shaped charge perforator.

A shaped charge is an energetic device made up of a housing within which is placed a liner, typically a metallic liner. The liner provides one internal surface of a void, the remaining surfaces being provided by the housing. The void is filled with an explosive which, when detonated, causes the liner material to collapse and be ejected from the casing in the form of a high velocity jet of material. This jet impacts upon the well casing creating an aperture and the jet then continues to penetrate into the formation itself, until the kinetic energy of the jet is overcome by the material in the formation. Generally, a large number of perforations are required in a particular region of the casing proximate to the formation. To this end, a so-called perforation gun is deployed into the casing by wireline, coiled tubing or any other technique known to those skilled in the art. The gun is effectively a carrier for a plurality of perforators, which perforators may be of the same or differing output.

SUMMARY OF THE INVENTION

In accordance with a first aspect of the invention, there is provided a reactive oil and gas well shaped charge perforator liner comprising a reactive composition of at least two metals wherein the liner is a compacted particulate composition comprising a spherical metal particulate and a non-spherical metal particulate. By reactive, we mean that the spherical metal particulate and the non-spherical metal particulate are together capable of an exothermic reaction to form an intermetallic compound, upon detonation of an associated shaped charge device.

There are a number of intermetallic alloying reactions that are exothermic and find use in pyrotechnic applications. For example, the alloying reaction between aluminium and palladium releases 327 cals/g and the aluminium/nickel system, producing the compound Ni—Al, releases 329 cals/g (2290 cals/cm$^3$). For comparison, on detonation, TNT gives a total energy release of about 2300 cats/cm$^3$, so the reaction is of similar energy density to the detonation of TNT, but of course with no gas release. The heat of formation for Ni—Al is about 17000 cal/mol at 293 degrees Kelvin and is due to the new bonds formed between two dissimilar metals.

In a conventional shaped charge, energy is generated by the direct impact of the high kinetic energy of the jet. Reactive jets, on the other hand, comprise a source of additional heat energy, which is available to be imparted into the target substrate (thereby causing more damage in the rock strata compared with non-reactive jets). Rock strata are typically porous and comprise hydrocarbons (gas and liquids) and/or water in said pores. In a shaped charge comprising a reactive liner according to the invention, the fracturing is caused by direct impact of the jet and also by a heating effect from the exothermic reactive composition. This heating effect imparts further damage by physical means, for example due to the rapid heating and concomitant expansion of the fluids present in the oil and/or gas well completion. This increases the pressure of the fluids, thereby causing the rock strata to crack. There may also be some degree of chemical interaction between the reactive composition and the materials in the completion. The increased fracturing increases the total penetrative depth and volume available for oil and gas to flow out of the strata.

Clearly the increase in depth and width of the hole leads to larger hole volumes and a concomitant improvement in oil or gas flow, i.e. a bigger surface area of the hole volume from which the fluid may flow.

In order for a metal particulate composition to be suitable for use in a shaped charge liner, it is desirable that the intermetallic reaction can be shock-induced at an appropriate threshold. An empirical and theoretical study of the shock-induced chemical reaction of nickel and aluminium powder mixtures shows that the threshold pressure for reaction is about 14 GPa for spherical particulate compositions. This pressure is easily obtained in the shock wave of modern explosives used in most shaped charge applications, and so Ni—Al can be used in a shaped charge liner to give a reactive, high temperature jet. The jet temperature has been estimated to be 2200 degrees Kelvin. The Pd—Al system is also suitable for use in a shaped charge liner. However, palladium is an expensive platinum group metal and hence, the nickel-aluminium system has significant economic advantages.

It is also desirable that the maximum amount of energy possible is derived from the liner, by ensuring that the intermetallic reaction goes to completion, close to completion or as close to completion as possible.

The effect of the particle sizes of the component metals on the properties of the resultant shaped charge jet is known to be an important factor for obtaining good performance. Micron and nanometric size aluminium and nickel powders are both available commercially and their mixtures undergo a rapid, self-supporting exothermic reaction. A hot Ni—Al jet of this type is highly reactive to a range of target materials; hydrated silicates in particular are attacked vigorously.

Despite the use of micron and sub-micron particles, however, the inventors have found that—in some liner applications—the intermetallic reaction does not always go to completion. As a result, the available energy from the intermetallic reaction is not completely extracted and hence, the fracturing and damage is not optimised. Moreover, in some applications (most particularly in the case of smaller shaped charges) it has been observed that enhanced hole penetration effects are reduced. This is thought to be because, in certain liner/explosive charge configurations (such as, for example, configurations implemented in smaller shaped charges), the reaction may not have run to completion throughout the available volume of the liner, which may in turn be because a particular geometry leads to non-uniform behaviour in the liner. In other words, in certain regions of the liner, the activation threshold may not have been exceeded and the intermetallic reaction may not have occurred.

The above mentioned activation threshold may simply relate to an activation pressure (more specifically a shock pressure), but the activation threshold is more likely to relate to a combination of factors, such as, for example, pressure, deformation and/or thermal factors. More generally, the activation threshold relates to the total energy imparted to the system and can be considered to be an activation energy. The skilled person will realise, of course, that the physical and chemical behaviour of a shaped charge liner in use is complex, and the invention is not intended to be limited by any explanation on activation thresholds.

In the invention, the reactive composition of the liner comprises metal particulates having different morphologies. More specifically, the liner comprises a compacted composition comprising a spherical metal particulate and a non-spherical metal particulate. One advantage of using a mixture of spherical and non-spherical particulates, particularly spherical and flaked particulates, is that the activation energy or externally applied pressure required to initiate an intermetallic reaction is reduced compared to mixtures which comprise only spherical metal particulates. Another advantage is that the intermetallic reaction is more likely to go to completion and hence, the exothermic energy output of the liner is increased. A yet further advantage is that the material of the reactive liner is typically consumed such that there is no slug of liner material left in the hole that has just been formed. (The slug that is left behind, with non-reactive liners, may create a yet further obstruction to the flow of oil and/or gas from the well completion.)

In the interests of clarity, the compacted particulate composition is a particulate composition comprising a spherical metal particulate and a non-spherical metal particulate which has been compacted (i.e. the spherical and non-spherical particles have been compacted together). It will be understood that the compaction process may cause some deformation of the component particulates, such that the spherical metal particulate—for example—becomes slightly aspherical. However, the aspect ratio of the non-spherical particulate remains greater than that of the spherical particulate.

The particulates may be of any commonly used size of particulate in compacted metal liners such as, for example, micron, sub-micron or even nanosized powders, provided that the non-spherical metal particulates have a greater aspect ratio than the spherical metal particulates. In the case of the non-spherical particulates, one or more dimensions may be of a different size order to one or more other dimensions. By way of illustration, the non-spherical particulate may be a flake having plane dimensions of the order (say) 100×50 microns, but the thickness may be nanometric (say around 1 nm).

By the term "aspect ratio" is meant the ratio of its longer or longest dimension to its shorter or shortest dimension.

By the term "spherical particulate" is meant a particulate that is produced by standard manufacturing methods as a spherical or near-spherical particulate. This may include, for example, an oblate spheroid.

Preferably, the spherical particulates have a diameter which is less than that of the average longest dimension of the non-spherical metal particulate. In a preferred arrangement, the spherical particulates have an average diameter of 50 microns or less, more preferably 25 microns or less and most preferably in the range of from 5 microns to 20 microns. Preferably, the average longest dimension of the non-spherical metal particulate is at least twice the diameter of the spherical particulate.

Preferably, the non-spherical metal is selected from a flaked, rod-shaped or ellipsoid particulate, more preferably a flaked particulate. In a preferred arrangement, the non-spherical particulate is a flaked particulate and preferably has an aspect ratio of less than 500:1, more preferably less than 3001, even more preferably has an aspect ratio in the range of from 10:1 to 3001, and most preferably has an aspect ratio in the range of 50:1 to 200:1. Preferably, the non-spherical metal particulate has an average longest dimension of less than 300 micron, more preferably an average longest dimension in the range of 2 micron to 50 micron.

The skilled person will realise that the term "flake" is generally means a flat, thin piece of material. In the invention, the flake may have any convenient regular or irregular shape, preferably a regular shape such as a square, rectangular, disc, oval or leaf shape. A rectangular or square flake is most preferred. Preferably, but not necessarily, the flaked particles are planar or near-planar.

Preferably, the more malleable metal out of the at least two metals is selected as the spherical particulate. This is because the inventors have found that, upon detonation, the compression caused by the shock wave provides better particle mixing and hence, a higher probability of reaction. For this reason, aluminium, when present in the reactive composition, is generally preferred as the spherical particulate.

The liner may further comprise at least one further inert metal which is substantially inert with respect to the rest of the reactive composition, the further metal preferably being present in an amount greater than 10% w/w of the liner. More preferably, the at least one further metal is present in an amount greater than 20% w/w of the liner, even more preferably greater than 40% w/w of the liner. In a yet further preferred option, the further metal is present in the range of from 40% to 95% w/w of the liner, more preferably in the range of from 40% to 80% w/w, yet more preferably 40% to 70% w/w of the liner. The percentage weight for weight w/w is with respect to the total composition of the liner.

The at least one further metal may be considered as being substantially non-reactive or substantially inert with respect to the rest of the reactive composition. By the term, "substantially inert" we mean that the further metal possesses only a reduced energy of formation with the reactive composition (if indeed any) compared with the energy of formation between the non-spherical and spherical particulates that form the reactive composition.

The at least one further metal is preferably selected from a high density metal. Particularly suitable metals are copper or tungsten, or an admixture thereof, or an alloy thereof. The at least one further metal is preferably mixed and uniformly dispersed within the reactive composition to form an admixture. Alternatively, the liner may additionally comprise a layer of at least one further metal, said layer typically being covered by a layer of the reactive composition. The layers can then be pressed to form a consolidated or compacted liner by any known pressing techniques.

Reaction between aluminium (for example) and the at least one further metal (such as, for example, tungsten or copper) is likely to be less favourable and less exothermic than the reaction between the aluminium and a flaked metal particulate (such as nickel or palladium) and is therefore not likely to be the main product of such a reaction. It will be clear to the skilled person, however, that although the reaction between the at least one further metal and aluminium is less favourable, there may still be a trace amount of such a reaction product observed upon detailed investigation.

As discussed above, the spherical metal particulate and the non-spherical metal particulate are together capable of an exothermic reaction to form an intermetallic compound, upon detonation of an associated shaped charge device. Accordingly, the respective metals are selected such that, when supplied with sufficient energy (i.e. an amount of energy in excess of the activation energy to cause the exothermic reaction), the metal particulates will react to produce a large amount of energy, typically in the form of heat.

The use of non-stoichiometric amounts of the spherical particulates and non-spherical metals particulates will provide an exothermic reaction. However, such a composition may not furnish the optimal amount of energy. In a preferred embodiment, the exothermic reaction of the liner is achieved by using a substantially stoichiometric (molar) mixture of at least two metals. The at least two metals are preferably selected such that they produce, upon activation of the shaped charge liner, an electron compound, with an accompanying release of heat and/or light. The reaction typically involves only two metals, although intermetallic reactions involving more than two metals are known and not excluded from the invention.

There are many different electron compounds (also know as intermetallic electron compounds or electron intermetallic compounds) that may be formed. Conveniently, these compounds may be grouped as Hume-Rothery compounds. Electron compounds are typically formed by high melting point metals (for example Cu, Ag, Au, Fe, Co, Ni) reacting with lower melting point metals (for example Cd, Al, Sn, Zn, Be). The Hume-Rothery classification identifies an intermetallic compound by means of its valence electron concentration, i.e. the ratio of valence electrons to atoms ($N_E$:$N_A$) taking part in the chemical bond. Typically, this can be expressed as the quotient of simple integers. Example ratios are 3/2, 7/4 and 21/13.

Preferably, in the invention, the at least two metals are selected to produce a Hume-Rothery intermetallic compound and more preferably, the at least two metals are selected to produce, in operation, intermetallic compounds which possess electron to atom ratios selected from 3/2, 7/4, 9/4 and 21/13. The reactive liner of the invention gives particularly effective results when the two metals (i.e. the spherical metal particulate and the non-spherical metal particulate) are provided in respective proportions calculated to give an electron atom ratio of 3/2, 7/4, 9/4 or 21/13, more preferably a ratio of 3 valency electrons to 2 atoms. Most preferably, the reactive composition comprises two metals which can react to form a Hume-Rothery compound having an electron to atom ratio of 3/2.

Accordingly, advantageous exothermic energy outputs can be achieved in the invention using stoichiometric compositions such as Co—Al, Fe—Al, Pd—Al, CuZn, $Cu_3Al$, $C_5Sn$ and Ni—Al (all of which have an electron concentration of 3/2). Aluminium-based compositions are particularly suitable because Al is a cheap, readily available material. Preferably, but not necessarily, the aluminium is a spherical particulate and the other metal is a non-spherical, preferably flaked, material. More preferred compositions are nickel and aluminium, or palladium and aluminium, preferably mixed in stoichiometric quantities. The above examples, when they are forced to undergo a reaction, provide excellent thermal output and, in the case of nickel, iron and aluminium, are relatively cheap materials. The most preferred composition is Ni—Al.

By way of example, important benefits are observed for a NiAl liner according to the invention. Using a uniaxial strain test system, it has been demonstrated that, when both metals are present as spherical metal particulates, the liner reacts only when subjected to a peak reflected pressure of >~14 GPa. This figure is reduced to around 6 GPa for spherical aluminium and flaked nickel. One advantage of using a lower threshold pressure to cause the intermetallic reaction (which corresponds to a lower activation energy for the triaxial stress system of a shaped charge) is ensuring that a greater percentage of the reaction goes to completion. A yet further advantage of a lower threshold pressure is that a lower output explosive may be used to produce the same effect. This is particularly beneficial for liners for small shaped charges (i.e. shaped charges having a diameter of less than about 32 mm), particularly for liners where the liner thickness begins to represent a significant portion of the size of the particles.

Preferably, the reactive composition comprises aluminium and at least one metal with which aluminium exothermically reacts to form an intermetallic compound. More preferably, the reactive composition comprises aluminium and at least one metal selected from the group consisting of Ce, Fe, Co, Li, Mg, Mo, Ni, Nb, Pb, Pd, Ta, Ti, Zn and Zr, more preferably from the group consisting of Ce, Fe, Co, Li, Mg, Ni, Pb, Pd, Ti, Zn and Zr, and most preferably from the group consisting of Fe, Co, Ni and Pd, in combinations which are known to produce an exothermic event when mixed. The aluminium may be provided as a spherical particulate, and the at least one metal as a non-spherical particulate, or vice versa.

In one preferred embodiment the liner composition comprises spherical aluminium and at least one flaked metal particulate. When supplied with sufficient energy (i.e. an amount of energy in excess of the activation energy to cause the exothermic reaction) the composition reacts to produce a large amount of energy, typically in the form of heat. The energy to initiate the electron compound (i.e. intermetallic) reaction is supplied by the detonation of the high explosive in the shaped charge device.

In the preferred embodiment, the non-spherical metal may be selected from metals in any one of Groups VIIIA, VIIA, VIA, IIB and 1B of the periodic classification. Preferably, the metal is selected from Group VIIIA VIIA and IIB, more preferably Group VIIIA. Ideally, the non-spherical metal is selected from the Group consisting of iron, cobalt, nickel and palladium.

The liner may be prepared by any suitable method, for example by pressing the composition to form a green compact. It will be obvious that any mechanical or thermal energy imparted to the reactive material during the formation of the liner must be taken into consideration so as to avoid an unwanted exothermic reaction. Preferably, the liner is an admixture of particulates of the reactive composition and the at least one further metal. Preferably, the liner is formed by pressing the admixture of particulates, using known methods, to form a pressed (also referred to as a compacted or consolidated) liner.

In the case of pressing the reactive composition to form a green compacted liner, a binder may be required. The binder may be a powdered soft metal or non-metal material. Preferably, the binder comprises a polymeric material such as PTFE or an organic compound such as a stearate, wax or epoxy resin. Alternatively, the binder may be selected from an energetic binder such as Polyglyn (Glycidyl nitrate polymer), GAP (Glycidyl azide polymer) or Polynimmo (3-nitratomethyl-3-methyloxetane polymer). The binder may also be a metal stearate, such as, for example, lithium stearate or zinc stearate.

Conveniently, the spherical particulates and/or the non-spherical particulates and/or the further metal which forms part of the liner composition is coated with one of the aforementioned binder materials. Typically, the binder, whether it is being used to pre-coat a metal or is mixed directly into the composition containing a metal, is present in the range of from 1% to 5% by mass.

Advantageously, if the longest dimension of the spherical particulates and the non-spherical particulates (such as, for example, nickel and aluminium, or iron and aluminium, or palladium and aluminium) in the composition of a reactive liner is less than 10 microns, and even more preferably less than 1 micron, the reactivity and hence the rate of exothermic reaction of the liner will be further increased. In this way, a reactive composition formed from readily available materials, such as those disclosed earlier, may provide a liner which possesses not only the kinetic energy of the cutting jet, as supplied by the explosive, but also the additional thermal energy from the exothermic chemical reaction of the composition.

At particle diameter sizes of less than 0.1 micron, the metals in the reactive composition become increasingly attractive as a shaped charge liner material due to their even further enhanced exothermic output on account of higher relative surface area of the reactive compositions. A yet further advantage of decreasing particle diameter is that, as the particle size of the at least one further metal decreases, the actual density that may be achieved upon consolidation increases. As particle size decreases, the actual consolidated density that can be achieved starts to approach the theoretical maximum density for the at least one further metal.

The reactive liner thickness may be selected from any known or commonly used wall liner geometries thickness. The liner wall thickness is generally expressed in relation to the diameter of the base of the liner and is preferably selected in the range of from 1 to 10% of the liner diameter, more preferably in the range of from 1 to 5% of the liner diameter. In one arrangement, the liner may possess walls of tapered thickness, such that the thickness at the liner apex is reduced compared to the thickness at the base of the liner. Alternatively, the taper may be selected such that the apex of the liner is substantially thicker than the walls of the liner towards its base. A yet further alternative is where the thickness of the liner is not uniform across its surface area or cross section; for example, a conical liner in cross section wherein the slant/slope comprises blended half angles scribed about the liner axis to produce a liner of variable thickness.

The shape of the liner may be selected from any known or commonly used shaped charge liner shape, such as substantially conical, tulip, trumpet or hemispherical.

According to a further aspect of the invention there is provided a reactive oil and gas well shaped charge perforator liner comprising a compacted particulate reactive composition, said composition comprising an aluminium particulate and at least one metal particulate, wherein the aspect ratio of the at least one metal particulate is greater than the aluminium particulate. By reactive, we mean that the aluminium particulate and the at least one metal particulate are together capable of an exothermic reaction to form an intermetallic compound, upon detonation of an associated shaped charge device.

Preferably, the composition comprises two metals that are capable of an exothermic reaction, the first metal being selected from aluminium and the second metal being selected from any one of Groups VIIIA, VIIA and IIB, wherein the aspect ratio of the second metal particulate is greater than the aluminium particulate.

Another aspect of the invention provides a method of producing a reactive shaped charge liner, said method comprising the steps of providing a composition of at least two metals and compacting said composition to form a liner, wherein the composition comprises a spherical metal particulate and a non-spherical metal particulate. By reactive is meant that the spherical metal particulate and the non-spherical metal particulate are together capable of an exothermic reaction to form an intermetallic compound, upon detonation of an associated shaped charge device.

According to a yet further aspect of the invention there is provided the use of a reactive composition in an oil and gas well shaped charge perforator liner, said reactive composition comprising at least two metals wherein the liner is a compacted particulate composition comprising a substantially spherical metal particulate and a non-spherical metal particulate.

There is also provided a method of improving fluid outflow from an oil or gas well comprising the step of using a reactive liner according to the invention. Preferably, the energy from the intermetallic reaction (i.e. from the liner) is imparted to the saturated substrate of a well.

There is further provided a compacted particulate reactive composition suitable for use in a shaped charge liner, said composition comprising aluminium and at least one metal that undergoes an exothermic intermetallic reaction with aluminium, wherein the aspect ratio of the at least one metal particulate is greater than that of the aluminium particulate. In operation, the composition provides thermal energy upon activation of an associated shaped charge, the thermal energy being imparted to the saturated substrate of the well.

A further aspect of the invention comprises a shaped charge suitable for down hole use comprising a housing, a quantity of high explosive and a liner as described hereinbefore located within the housing, the high explosive being positioned between the liner and the housing.

Preferably, the housing is made from steel, although the housing could instead be formed partially or wholly from one of the reactive liner compositions as hereinbefore defined, preferably by one of the aforementioned pressing techniques. In the latter case, upon detonation, the case will be consumed by the reaction. Advantageously, this reduces the likelihood of the formation of fragments. If fragments are not substantially retained by the confines of the perforating gun, they may cause a further obstruction to the flow of oil or gas from the well completion.

The high explosive may be selected from a range of high explosive products such as RDX, TNT, RDX/TNT, HMX, HMX/RDX, TATB, HNS. It will be readily appreciated that any suitable energetic material classified as a high explosive may be used in the invention. Some explosive types are however preferred for oil well perforators, because of the elevated temperatures experienced in the well bore.

The diameter of the liner at the widest point, that being the open end, can either be substantially the same diameter as the housing, such that it would be considered as a full calibre liner or alternatively the liner may be selected to be sub-calibre, such that the diameter of the liner is in the range of from 80% to 95% of the full diameter. In a typical conical shaped charge with a full calibre liner the explosive loading between the base of the liner and the housing is very small, such that in use the base of the cone will experience only a minimum amount of loading. Therefore in a sub calibre liner a greater mass of high explosive can be placed between the base of the liner and the housing to ensure that a greater proportion of the base liner is converted into the cutting jet.

The depth of penetration into the well completion is a critical factor in well completion engineering, so it is usually desirable to fire the perforators perpendicular to the casing to achieve the maximum penetration, and—as highlighted in the prior art—typically also perpendicular to each other to achieve the maximum depth per shot. It may be desirable to locate and align at least two of the perforators such that the cutting jets will converge, intersect or collide at or near the same point. In an alternative embodiment, at least two perforators are located and aligned such that the cutting jets will converge, intersect or collide at or near the same point, wherein at least one perforator is a reactive perforator as hereinbefore defined. The phasing of perforators for a particular application is an important factor to be taken into account by the completion engineer.

The perforators as hereinbefore described may be inserted directly into any subterranean well completion. However, it is usually desirable to incorporate the perforators into a perforation gun, in order to allow a plurality of perforators to be deployed into the well completion.

According to a further aspect of the invention there is provided a method of completing an oil or gas well using one or more shaped charge perforators, or one or more perforation guns as hereinbefore defined.

It will be understood by the skilled man that inflow is the flow of fluid, such as, for example, oil or gas, from a well completion.

Conveniently, improvement of fluid inflow may be provided by the use of a reactive liner which reacts to produce a jet with a temperature in excess of 2000 K, such that in use said jet interacts with the saturated substrate of an oil or gas well, causing increased pressure in the progressively emerging perforator tunnel. In a preferred embodiment, the oil or gas well is completed under substantially neutral balanced conditions. This is particularly advantageous as many well completions are performed using under balanced conditions to remove the debris form the perforated holes. The generation of under balance in a well completion requires additional equipment and expense. Conveniently, the improvement of inflow of the oil or gas well may be obtained by using one or more perforators or one or more perforation guns as hereinbefore defined.

Accordingly, there is further provided an oil and gas well perforation system intended for carrying out the method of improving inflow from a well comprising one or more perforation guns or one or more shaped charge perforators as hereinbefore defined.

According to a further aspect of the invention there is provided the use of a reactive liner or perforator as hereinbefore defined to increase fracturing in an oil or gas well completion for improving the inflow from said well.

A yet further aspect of the invention provides the use of a reactive liner or perforator or perforation gun as hereinbefore defined to reduce the debris in a perforation tunnel. The reduction of this type of debris is commonly referred to, in the art, as clean up.

According to a further aspect of the invention there is provided a method of improving inflow from a well comprising the step of perforating the well using at least one liner, perforator, or perforation gun according to the present invention. Inflow performance is improved by virtue of improved perforations created, that is larger diameter, greater surface area at the end of the perforation tunnel and cleaned up holes, holes essentially free of debris.

Previously in the art, in order to create large diameter tunnels/fractures in the rock strata, big-hole perforators have been employed. The big-hole perforators are designed to provide a large hole, with a significant reduction in the depth of penetration into the strata. Engineers can use combinations of big-hole perforators and standard perforators to achieve the desired depth and volume. Alternatively, tandem devices liners have been used which incorporate both a big-hole perforator and standard perforator. This typically results in fewer perforators per unit length in the perforation gun and may cause less in-flow. Big hole perforators can also be used in comminuted powder formations in combination with a sand screen to avoid in-flow after perforation of the loose sand/powder.

Advantageously, the reactive liners and perforators hereinbefore defined give rise to an increase in penetrative depth and volume, using only one shaped charge device. A further advantage is that the reactive liners according to the invention performs the dual action of depth and diameter (i.e. hole volume) and so there is no reduction in explosive loading or reduction in numbers of perforators per unit length.

Any feature in one aspect of the invention may be applied to any other aspects of the invention, in any appropriate combination. In particular, device aspects may be applied to method and/or use aspects, and vice versa.

DESCRIPTION OF THE DRAWINGS

In order to assist in understanding the invention, a number of embodiments thereof will now be described, by way of example only and with reference to the accompanying drawing, in which.

DESCRIPTION OF THE INVENTION

Figure 1:
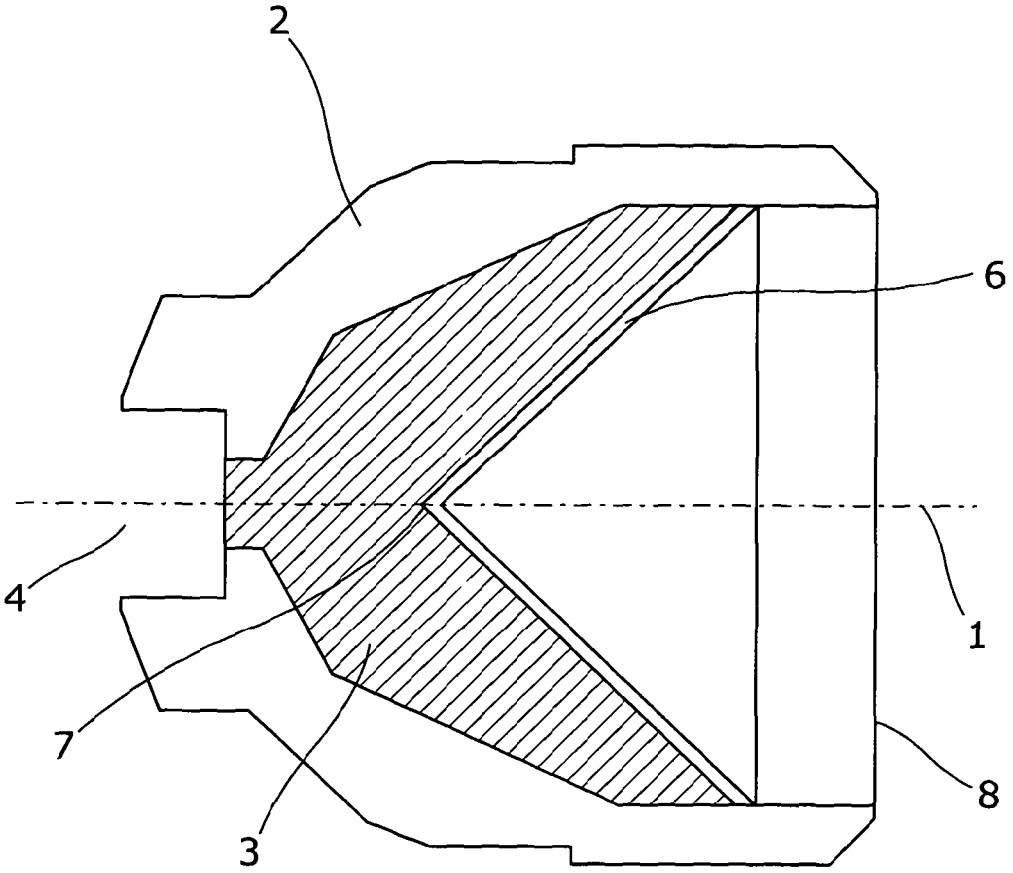
FIG. 1 is a cross-sectional view along a longitudinal axis of a shaped charge device containing a liner according to the invention.

FIG. 1 is a cross-sectional view of a shaped charge, typically axially-symmetric about centre line 1, of generally conventional configuration comprising a substantially cylindrical housing 2 produced from a metal (usually, but not exclusively, steel), polymeric, GRP or reactive material according to the invention. The liner 6 according to the invention has a wall thickness of typically 1 to 5% of the liner diameter, but may be as much as 10% in extreme cases and to maximise performance is of variable liner thickness. The liner 6 fits closely into the open end 8 of the cylindrical housing 2. High explosive material 3 is located within the volume enclosed between the housing and the liner. The high explosive material 3 is initiated at the closed end of the device, proximate to the apex 7 of the liner, typically by a detonator or detonation transfer cord which is located in recess 4.

One method of manufacture of liners is by pressing a measure of intimately mixed and blended powders in a die set to produce the finished liner as a green compact. Alternatively, intimately mixed powders may be employed in the same way as described above, but the green compacted product is a near net shape allowing some form of sintering or infiltration process to take place.

Modifications to the invention as specifically described will be apparent to those skilled in the art, and are to be considered as falling within the scope of the invention. For example, other methods of producing a fine grain liner will be suitable.

Figure 2:
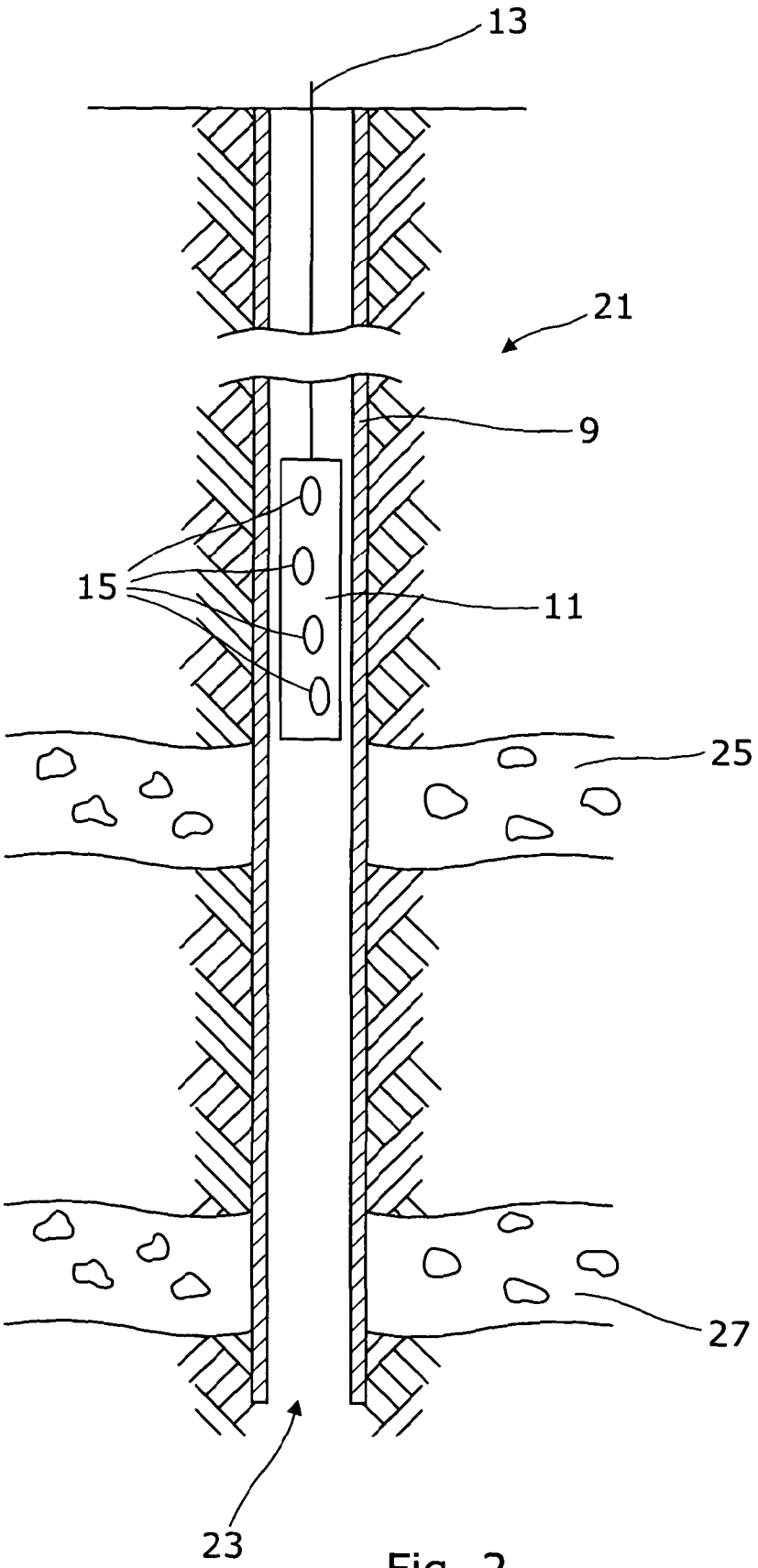
FIG. 2 is a sectional view of a well completion in which a perforator according to an embodiment of the invention may be used.

With reference to FIG. 2, there is shown a stage in the completion of a well 21 in which the well bore 23 has been drilled into a pair of producing zones 25, 27 in, respectively, unconsolidated and consolidated formations. A steel tubular casing 9 is cemented within the bore 23. In order to provide a flow path from the production zones 25, 27 into the annulus that will eventually be formed between the casing 9 and production tubing (not shown) which will be present within the completed well, it is necessary to perforate the casing 9. In order to form perforations in the casing 9, a gun 11 is lowered into the casing on a wireline, slickline or coiled tubing 13, as appropriate. The gun 11 is a generally hollow tube of steel comprising ports 15 through which perforator charges of the invention (not shown) are fired.

EXAMPLES

Experiments were conducted to compare the reactive behaviour of the following samples, using similar initial density and shock loading conditions:

- a NiAl composition comprising a 1:1 molar ratio of spherical Ni particulates and spherical Al particulates, each of size 7-15 micron.
- a NiAl composition comprising a 1:1 molar ratio of flaked Ni particulates (44 micron by 0.37 micron, aspect ratio 119:1) and spherical Al particulates (5-15 micron).

The TMD of all tests samples was about 60%.

Figure 3:
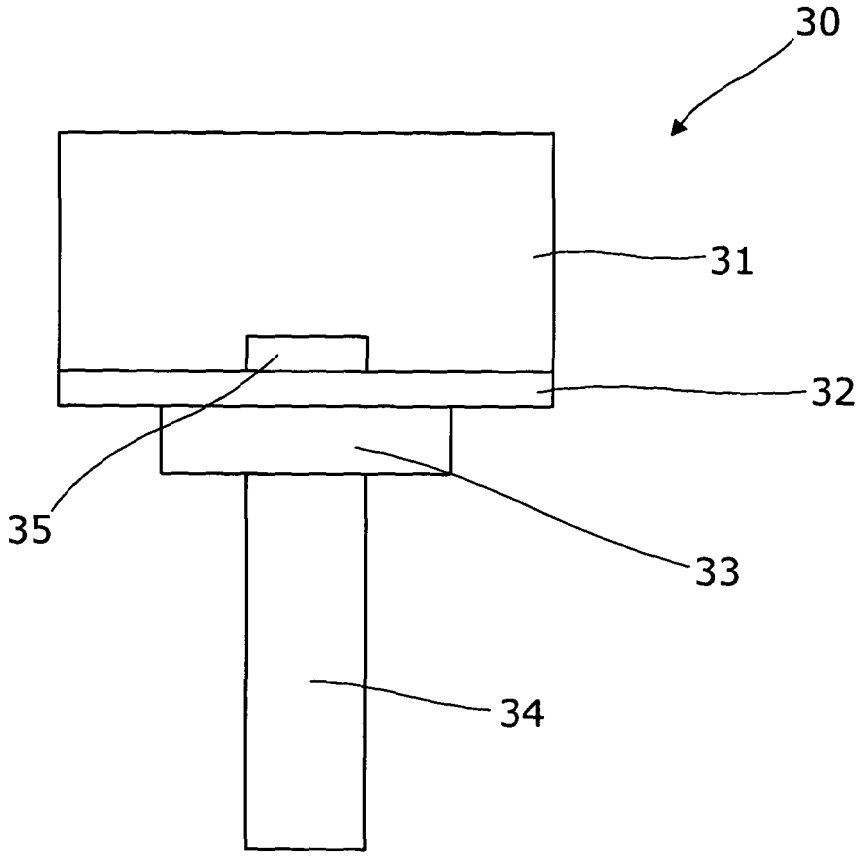
FIG. 3 is a schematic representation of an explosive anvil system used to test reactive compositions for use in the liner of the invention.

Referring to FIG. 3, an explosive anvil system 30 was used to test the samples, the system comprising a steel anvil 31, a steel cover plate 32, SX2 explosive 33 and an RP80 detonator 34. The sample to be tested was placed in recess 35 in anvil 31.

Initial tests were conducted using a 6 mm thickness of SX2. The skilled person will realise that thresholds depend on the type of shock loading and accordingly, the loadings quoted in respect of the anvil tests do not necessarily equate with the loading in a shaped charge.

Figure 4:
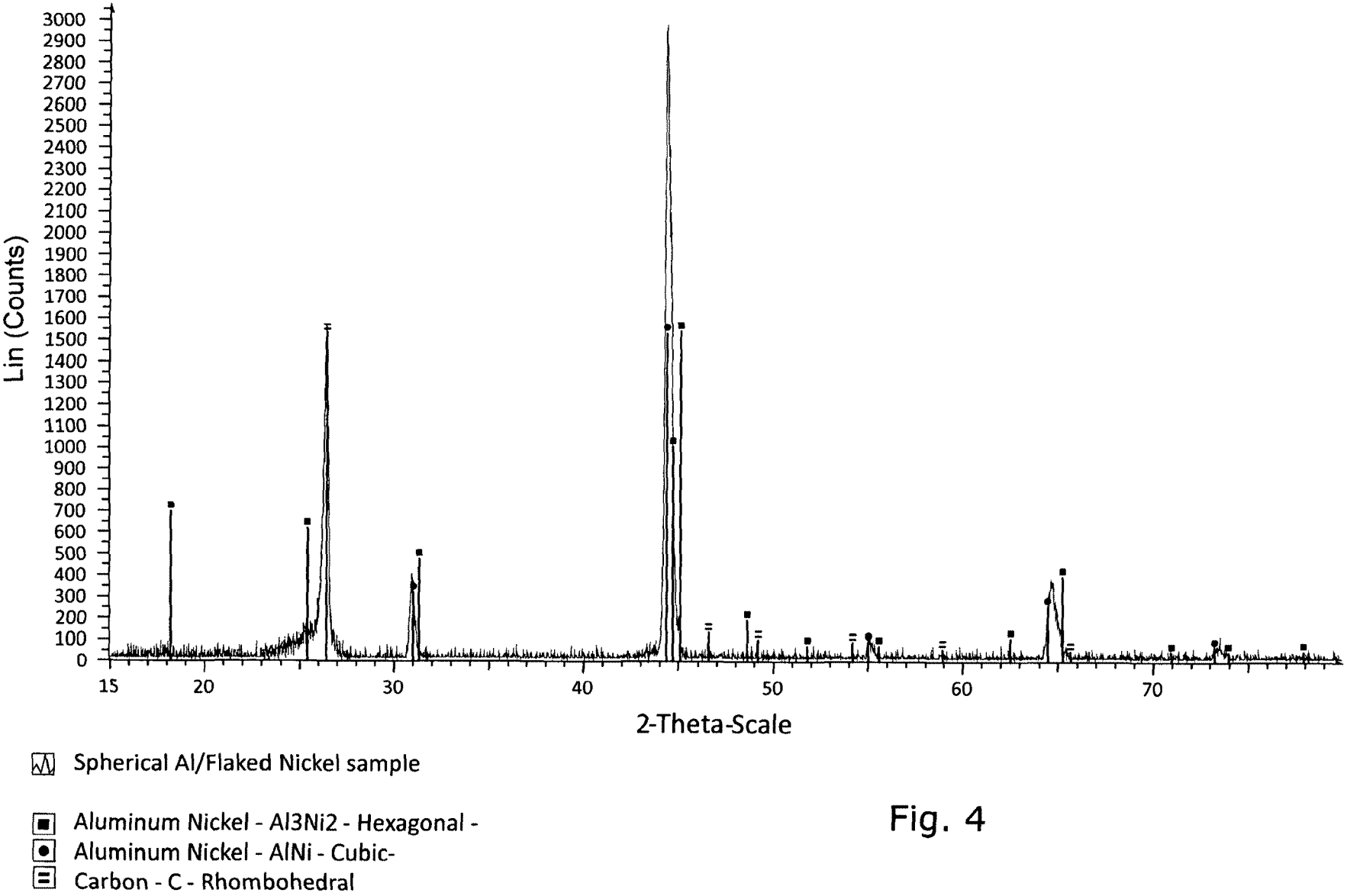
FIG. 4 is an XRD trace for a non-spherical/spherical NiAl particulate composition tested in the system of FIG. 3.

The samples were subjected to shock and recovered for analysis. It was found that the Ni flake/AI sphere sample according to the invention had undergone close to 100% reaction to form an intermetallic compound. X-ray diffraction (XRD) analysis confirmed that the main reaction products were NiAl and $Ni_2Al_3$, with traces of $Ni_5Al_3$ and $Ni_3Al$ (see FIG. 4).

In contrast, approximately 5% of the spherical Ni/spherical Al sample reacted to form an intermetallic compound. The test was repeated using a 9 mm thickness of SX2. It was found that increasing the explosive loading increased the extent of reaction to about 10%.

It can be concluded that, under identical loading conditions, a reactive composition comprising a spherical metal particulate and non-spherical metal particulate produces more energy. Conversely, a desired energy output can be obtained at a lower detonation threshold. It follows that a shaped charge liner according to the invention provides similar benefits. For small charges in particular, liners according to the invention can be used to maximise the volume of the shaped charge jet at high temperature, thereby ensuring that more thermal work is put into the target.

It will be understood that the present invention has been described above purely by way of example, and modification of detail can be made within the scope of the invention. Each feature disclosed in the description and (where appropriate) the claims and drawings may be provided independently or in any appropriate combination.

The invention claimed is:

1. A reactive oil and gas well shaped charge perforator liner comprising:

- a reactive composition of at least two metals wherein the liner is a compacted particulate composition comprising a spherical metal particulate and a non-spherical metal particulate,
- wherein the at least two metals are selected such that they produce, upon activation of the shaped charge liner, an electron compound,
- wherein the non-spherical metal particulate is selected from Ce, Fe, Co, Li, Mg, Mo, Ni, Nb, Pb, Pd, Ta, Ti, Zn, or Zr,
- wherein the non-spherical particulate has an average longest dimension of less than 300 microns, wherein the average longest dimension of the non-spherical metal particulate is at least twice the diameter of the spherical particulate, wherein the non-spherical particle has an aspect ratio of from 50:1 to 200:1,
- wherein the liner further comprises at least one further metal particulate, which is substantially inert with the at least two metals and the further metal is present in an amount greater than 10% w/w of the liner,
- and wherein the at least two metals and at least one further metal are uniformly dispersed to form an admixture.

2. The liner according to claim 1, wherein the electron compound is a Hume-Rothery compound having an electron to atom ratio of 3/2.

3. The liner according to claim 1, wherein the more malleable of the at least two metals is selected as the spherical metal particulate.

4. The liner according to claim 1, wherein the spherical metal particulate is aluminium.

5. The liner according to claim 1, wherein the non-spherical metal particulate is selected from Group VIIIA, VIIA, and IIB of the periodic classification.

6. The liner according to claim 1, wherein the non-spherical metal particulate is selected from Ni, Pb, and Ti.

7. The liner according to claim 1, wherein the non-spherical metal particulate is selected from a flaked, rod-shaped or ellipsoid particulate.

8. The liner according to claim 7, wherein the non-spherical metal particulate has an aspect ratio of greater than 2:1.

9. The liner according to claim 8, wherein the non-spherical metal particulate has an aspect ratio in the range of from 10:1 to 200:1.

10. The liner according to claim 1, wherein the non-spherical metal particulate has an average longest dimension in the range of 2-50 microns.

11. The liner according to claim 1, wherein the spherical metal particulate has an average diameter of 50 microns or less.

12. An oil and gas well shaped charge perforator comprising a liner according to claim 1.

13. A method of completing an oil or gas well using one or more shaped charge perforators according to claim 12.

14. A perforation gun comprising one or more perforators according to claim 12.

15. A method of completing an oil or gas well using one or more perforation guns according to claim 14.

16. A method of completing an oil or gas well using one or more shaped charge liners according to claim 1.

17. A method of producing a reactive shaped charge liner according to claim 1, the method comprising:

providing a composition of at least two metals; and compacting said composition to form a liner, wherein the composition comprises a spherical metal particulate and a non-spherical metal particulate.

* * * * *